United States Patent [19]

McCabe

[11] 4,287,638

[45] Sep. 8, 1981

[54] INSIDE/OUTSIDE LINK

[76] Inventor: Francis J. McCabe, 239 Hastings Ct., Doylestown, Pa. 16506

[21] Appl. No.: 964,655

[22] Filed: Nov. 29, 1978

[51] Int. Cl.[3] ..... E05F 15/2

[52] U.S. Cl. ..... 16/48.5; 49/1

[58] Field of Search ..... 16/48.5; 49/1, 2; 160/6, 1, 2, 5, 9; 98/86; 126/287.5; 137/457

[56] References Cited

U.S. PATENT DOCUMENTS

| | | | |
|---|---|---|---|
| 1,479,789 | 1/1924 | Collin | 137/457 X |
| 2,148,530 | 2/1939 | Burke | 126/287.5 UX |
| 3,725,972 | 4/1973 | McCabe | 16/48.5 |
| 3,796,248 | 3/1974 | McCabe | 160/1 |
| 3,796,249 | 3/1974 | McCabe | 160/1 |
| 3,889,314 | 6/1975 | McCabe | 16/48.5 |
| 4,041,570 | 8/1977 | McCabe | 16/48.5 |
| 4,074,388 | 2/1978 | McCabe | 16/48.5 |
| 4,080,978 | 3/1978 | McCabe | 49/2 X |
| 4,099,292 | 7/1978 | McCabe | 160/1 |
| 4,146,048 | 3/1979 | McCabe | 160/1 X |

*Primary Examiner*—Andrew V. Kundrat

*Attorney, Agent, or Firm*—Benasutti Associates, Ltd.

[57] ABSTRACT

A releasable link is mounted on the wall of a duct, plenum, chamber or the like. The link releases in response to a predetermined increase of temperature within the duct. The link is resettable without having to gain access to the interior of the duct. In addition, the link can be released manually or remotely from the outside. In another embodiment, in addition to being resettable as well as manually and/or remotely releasable from the outside, the link is releasable in response to a predetermined temperature increase occurring either within or outside of the duct.

28 Claims, 6 Drawing Figures

INSIDE/OUTSIDE LINK

BACKGROUND OF THE INVENTION

This invention relates to links which are releasable in response to predetermined increases in temperature, and more particularly to releasable links for use with devices such as fire/smoke dampers in air ducts, plenums, chambers and the like.

Fire dampers, smoke dampers, air control dampers or other fire protection equipment which may be located in ducts, plenums, chambers and the like are often preferably installed with activation devices which will respond to increases in temperature within the duct, etc., within which the damper or other fire protection apparatus is installed. In order to insure operation of such activation devices, however, it is advantageous to provide a mechanical-type of releasing device which may respond to a fail/-safe manner to such increases in temperature. Commonly, these devices have included fusable links which are disposed along cables located within the area to be sensed which will melt thereby releasing the cable and/or associated equipment in response to increases in heat. Alternatively, bimetallic releasing devices, such as those disclosed in my prior U.S. Pat. Nos. 3,889,314 and 3,725,972, have been utilized in such installations.

While the above devices have often provided satisfactory results, mounting them within a duct, plenum, or other chamber has often necessitated provision of an access door through the wall of the duct or plenum, so that they may be manually replaced or reset, as needed. Not only are such access doors relatively expensive, resetting or replacement of links disposed within the duct or plenum serviced thereby is often cumbersome, thereby tending to inhibit frequent testing of those devices even when those devices can be remotely activated, as by receipt of an electric or pneumatic signal. Additionally, cable mounting of such devices within a duct, plenum, chamber, etc., even if provided with remote activation capabilities, have not uniformly been readily testable by a safety engineer present outside the duct in the immediate vicinity of the damper for the purpose of evaluating the effectiveness of that activation.

SUMMARY OF THE INVENTION

The present invention provides a novel apparatus which overcomes many of the problems heretofore associated with releasing devices which are intended to activate associated equipment in response to increases in the ambient temperature in the vicinity of that equipment. This is accomplished by providing a dome-shaped mounting plate for mounting against an exterior surface of the duct, plenum, chamber, etc., over an aperture formed therein.

A bimetallic element, preferable a serpentine bimetallic element similar to that described in my prior U.S. Pat. No. 3,889,314, is mounted in the concave portion of the dome so that its exterior surfaces will face the interior of the duct to be serviced by way of the aperture. The base of the bimetallic element can be mounted either directly to the undersurface of the "roof" of the dome or alternatively, indirectly to the "roof" through a mounting element which is similar to the mounting element disclosed in U.S. Pat. No. 3,889,314.

The dome-shaped mounting plate acts to position a pin mounted on the bimetallic element so that at least the tip thereof will be adjacent to a side of the dome. A pawl-receiving aperture is formed in the side to guide a pawl inserted therethrough selectively into contact with the pin. Accordingly, a pawl may be slipped through the pawl-receiving aperture in the side of the dome to engage the pin for gripping thereby. A cable or other means may be attached to the pawl on the outside of the duct, and may be threaded to a remote point along the duct, through a ferrule disposed through the wall thereof to engage and operate associated fire protection apparatus, such as a damper for example.

In addition, the device may also include an exterior link/pawl assembly wherein the mounting element of a bimetallic link is modified to engage the pin of the bimetallic element disposed within the dome whereby its bimetallic element is presented to the atmosphere outside of the duct with which the fire protection apparatus is associated. Consequently, the device will release as a result of a predetermined increase in temperatures either within or outside of the duct or both.

A manual release can be provided in order to enable manual testing of the device from outside of the duct, plenum or chamber, etc. The manual release is a spring biased member mounted through the top surface or "roof" of the dome which, in its normal position does not interfere with the operation of the bimetallic element. In addition to or in place of the manual release, a remotely operated actuator, such as a solenoid or pnuematically operated cylinder can be used to effectuate release. The link may also include heating means for actuating the bimetallic element and secondary circuit control means for actuating signals or controlling current to the heating means.

Accordingly, it is an object of the present invention to provide a heat actuatable releasing device which is responsive to an increase in temperature within a duct, plenum, chamber or the like and which is resettable from the outside.

Another object of the present invention is the provision of a heat actuatable releasing device which is also capable of manual activation from outside the duct, plenum, chamber or the like.

A further object of the present invention is the provision of a releasing device that is responsive to temperature increases occurring both within and outside of the duct, plenum, chamber or the like.

A further object of the present invention is to provide a heat actuatable releasing device which is also capable of actuation by a remote signal source, such as a smoke detector or the like.

These and other objects of my invention will become apparent from the following description with reference to the accompanying drawings.

DETAILED DESCRIPTION OF THE DRAWINGS

Figure 1:
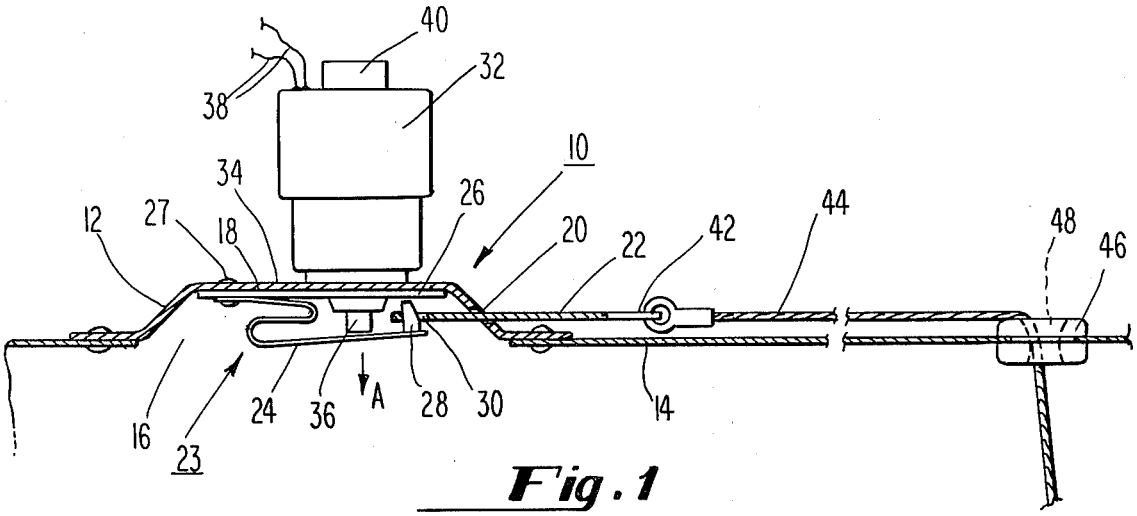
FIG. 1 is a side view of one embodiment of a releasing device of the present invention.

Although specific forms of the invention have been selected for illustration in the drawings, and the following description is drawn in specific terms for the purpose of describing these forms of the invention, this description is not intended to limit the scope of the invention which is defined in the appended claims.

Referring to FIG. 1, there is shown a releasing device of the present invention, designated generally 10. The device 10 comprises a dome-shaped mounting member 12 which in use is mounted on a fluid barrier, for example a wall 14 of an air duct. The mounting member 12 is mounted over and substantially encloses an aperture 16 in the wall 14. The concave surface of the dome-shaped mounting member 12 has, in the preferred embodiment, a flattened region 18 which faces the aperture 16.

The mounting member 12 includes an aperture 20 in one of the walls thereof adapted to receive a releasable member or pawl 22 therethrough. The device 10 also comprises gripping means, designated generally 23, which includes a bimetallic element 24 which is mounted on the flattened region 18 of the mounting member 12. When the device 10 is installed on the duct wall 14 as shown in FIG. 1, the bimetallic element 24 is exposed to the ambient environment within the duct through the aperture 16. The bimetallic element 24 may be mounted directly to the mounting member 12 or my be indirectly mounted thereto by way of an intermediate striker portion 26 such as disclosed in my prior U.S. Pat. No. 3,889,314. Such mounting may be effected by suitable fastening means such as rivets 27. A pin 28 extends from an end of the bimetallic element 24 which is remote from the aforementioned fastening means 27. The pin 28 is located in proximity to the aperture 20 in the wall of the mounting member 12. The pawl 22 has an aperture 30 therein which is adapted to receive the pin 28 therethrough.

In a normal, unheated position of the gripping means 23, the bimetallic element 24 is disposed so that pin 28 will extend through the aperture 30 in the pawl 22, whereby the end of the pin 28 which is remote from the bimetallic element 24, is adjacent the striker portion 26 as shown in FIG. 1. The end of the pin 28 is also beveled to permit the engagement of the pawl 22. When the gripping means 23 is in the normal position, engagement of the pawl 22 is effected by inserting the pawl 22 through the aperture 20 in the mounting member 12 and thereafter against the bevel of the pin 28 thereby forcing the pin 28 away from the striker portion 26 and allowing the pawl 22 to slide into position in which the aperture 30 in the pawl 22 aligns with the pin 28 and is pierced thereby as pin 28 returns to its normal position adjacent the striker portion 26, as shown in FIG. 1.

The bimetallic element 24 should be so formed that it assumes the normal position when exposed to the ambient temperature of its expected installation wherein, as shown for example in FIG. 1, the bimetallic element 24 is exposed to the ambient within the duct. The bimetallic element 24 itself is made of a conventional bimetallic material selected for its characteristic strength, elastic memory and ability to resist fatigue when bent to the desired configuration. The bimetallic element 24 is made of two flat strips of dissimilar material adhered together in any well known manner. Bimetallic elements are commonly used in thermostats and the like. See for example the bimetallic fire links disclosed in my prior U.S. Pat. Nos. 3,725,972 and 3,889,314. Consequently, the bimetallic element 24 can be a serpentine element as disclosed in U.S. Pat. No. 3,889,314 or may be configured as illustrated in U.S. Pat. No. 3,725,972, the serpentine element being preferred.

As shown in FIG. 1, a remotely actuatable device, for example an electrically operated solenoid 32, is mounted on a flattened region 34 of the convex surface of the dome-shaped mounting member 12. The solenoid 32 is of a suitable type well known in the art, having an operating rod 36 slidably mounted within the solenoid 32 and which extends therefrom in the direction indicated by arrow A in response to a voltage applied to the wires 38. The operating rod 36 is also manually extensible by depressing the button 40.

The pawl 22 has an attachment site 42 for attaching a cable 44 or other tension maintaining means such as chains or straps. The cable 44 is attached to the pawl 22 at the attachment site 42 on the outside of the duct and is threaded to a remote point along the duct wall 14, through a ferrule 46 disposed in an aperture 48 in the duct wall 14 to engage and operate the associated fire protection apparatus, such as a damper (not shown), which is disposed within the duct. In the preferred embodiment, the location of the ferrule 46 relative to the attachment site 42 of the pawl 22 is such that the distance between the ferrule 46 and the attachment site 42 when the apparatus is set will in turn define the maximum travel of the cable 44 upon activation of the device.

The operation of the releasing device 10 is as follows. In describing the operation, reference will be made to the use of the device in associatin with a fire damper in an air duct. However, it will be understood that the device of the present invention is operable with respect to a plenum, chamber, or other forms of fluid containing or conducting means as well as with other types of fire protection apparatus, for example fire screens, associated therewith. The done-shaped mounting member 12, having the bimetallic element 24 disposed in the concave portion thereof, is mounted over the aperture 16 in the duct wall 14 such that the aperture 16 is enclosed by the mounting member 12. In the preferred embodiment, the mounting member 12 is a solid structure having only the pawl receiving aperture 20, an operating rod receiving aperture (not shown) and those apertures required for receiving rivets (if used) therethrough. This configuration substantially prevents the fluid medium such as air within the duct from undesirably leaking outside the duct wall 14 through the aperture 16. The solenoid 32 is electrically connected to a remote voltage source (not shown). This voltage may be generated by a switch on a control panel, or in response to a signal from a smoke detector, or other desirable remote actuation means, adapted to provide an operating voltage to the solenoid 32.

Assuming that the temperature within the duct is within the prescribed normal operating range, the bimetallic element 24 will be in the normal position shown in FIG. 1. For purposes of this description, it will be assumed that the cable 44 which is attached to the pawl 22 at the attachment site 42, travels along the outside surface of the duct wall 14 for a predetermined distance at which point it passes through the ferrule 46 disposed in the aperture 48 through the duct wall 14 in order to engage and operate the associated fire protection equipment, such as a damper in this example (not shown). As previously stated, the distance between the ferrule 46 and the attachment site 43, when the apparatus is set, defines, the maximum travel of the cable upon activation of the device 10 and shall be long enough to ensure that the damper is able to fully close upon release of the device 10. In addition, the diameter of the ferule 46 is smaller than the width of the pawl 22 thereby insuring that the pawl 22 will not inadvertently drop into the duct after the device 10 has released.

The device 10 is set by inserting the pawl 22 through the aperture 20 in the wall of the mounting member 12 far enough to engage the pin 28 in the aperture 30 of the pawl 22. This setting operation is performed without having to gain access to the interior of the duct. The device 10 is now been set.

In the embodiment shown in FIG. 1, the device 10 can be released by any of three methods. Since the primary function of the device 10 is to release in response to a predetermined increase in the monitored temperature, this method of release will be discussed first. In the embodiment shown in FIG. 1, the bimetallic element 24 will move to an activated position in the direction indicated by arrow A as the temperature of the air within the duct increases. When the temperature reaches a predetermined magnitude, the bimetallic element 24 is in the activated position wherein the attached pin 28 has withdrawn from the aperture 30 in the pawl 22 thereby disengaging the pawl 22. The open damper normally maintains tension on the cable 44. Consequently, when the pawl 22 has been released by the bimetallic element 24, the pawl 22 will be withdrawn through the aperture 20 in the mounting member 12 by the closing damper. The pawl 22 will continue to travel along the outside of the duct wall 14 until the damper has assumed the closed position. The small aperture size of the ferrule 46 with respect to the pawl 22 will prevent the pawl 22 from being pulled into the duct as previously described. When the temperature of the ambient within the duct has fallen to within the predetermined normal limits, the bimetallic element 24 will return to the position shown in FIG. 1 and the device can be reset by merely withdrawing the cable 44 and reinserting the pawl 22 through the aperture 20 in the mounting member 12 and into engaging relationship with the pin 28 on the bimetallic element 24.

Another method of releasing the device 10 is particularly advantageous for periodic testing of the apparatus. This is accomplished, using the embodiment of the present invention shown in FIG. 1, by depressing the button 40 located on the outside of the solenoid 32. This causes the operating rod 36 to extend in the direction indicated by the arrow A whereupon it engages the bimetallic element 24, ultimately causing the pin 28 to be withdrawn from the aperture 30 in the pawl 22 thereby releasing the pawl 22 as previously discussed in the elevated temperature releasing example above. The movement of the cable into the duct through the ferrule 46 gives the operator visual evidence of the operability of the apparatus.

A third method of releasing the device 10 as shown in the embodiment of FIG. 1, is by applying a voltage to the wires 38 of the electrically operated solenoid 32. This is a versatile method of release since the voltage which is applied to the wires 38 can emanate from any one or more of a variety of sources. For example, the source may be a switch mounted on a centrally located control panel as previously described. The switch can operated in conjunction with a set of ancillary contacts (not shown) incorporated in the releasing device as described in my prior U.S. Pat. No. 3,889,314, and shown in FIG. 4 therein. These contacts may be used to activate a signal light to indicate status of the device, that is whether it is in the normal or activated position. The operating voltage may also emanate from a device in response to a signal from a smoke detector as previously described. The smoke detector may be any one of a number of well known devices currently on the market which produces a signal upon detection of smoke. The signal can be applied to any suitable electrical interface apparatus which produces the requisite voltage in response to the applied signal. Consequently, it can be seen that the embodiment of the invention shown in FIG. 1 is resettable from outside the duct; and, is releasable in response to an elevated temperature within the duct, manually at the site of the link, or remotely in response to signals from remotely located devices such as smoke or fire detectors or at a control panel.

Figure 2:
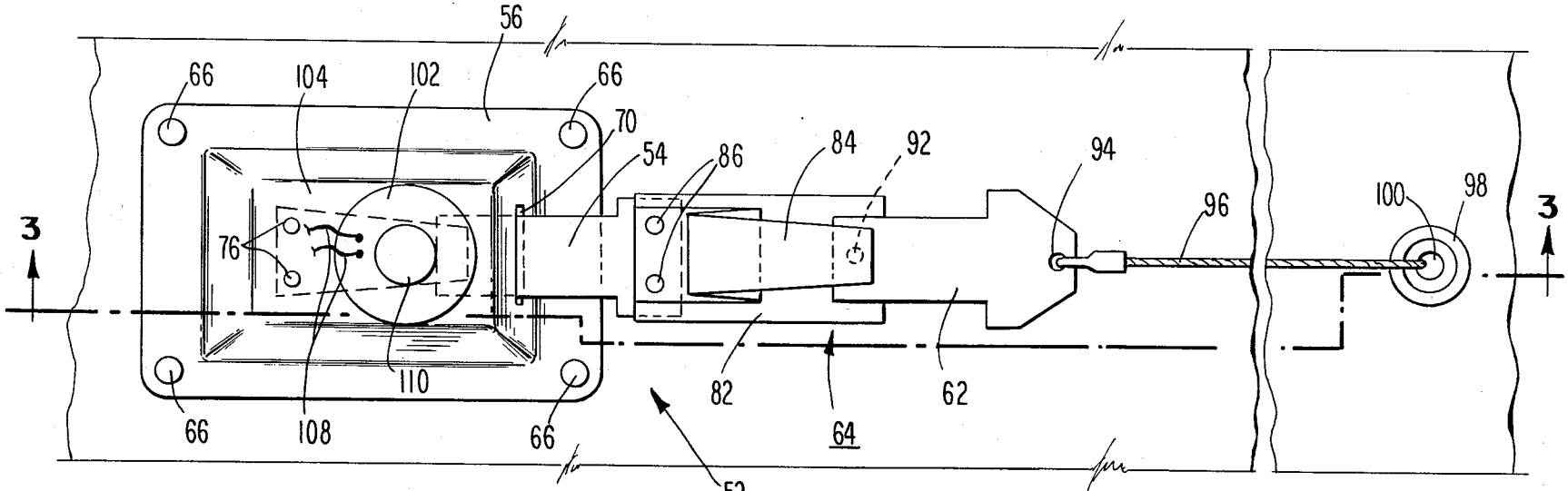
FIG. 2 is top plan view of another embodiment of the releasing device of the present invention showing a pair of releasable/resettable links in tandem.
Figure 3:
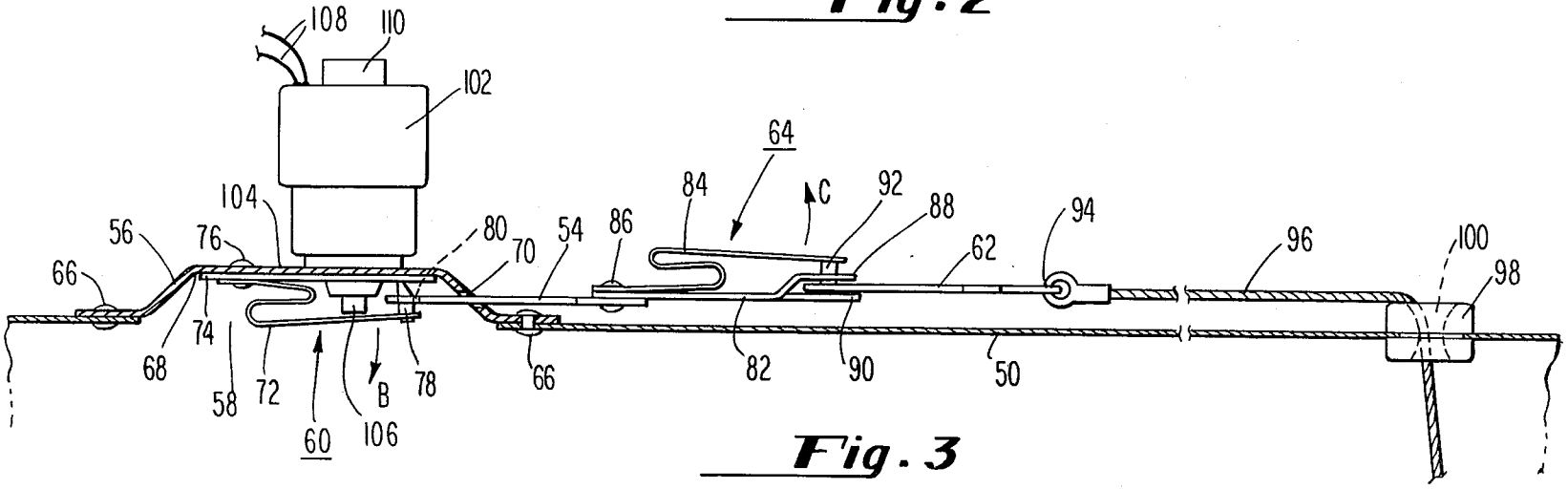
FIG. 3 is a fragmentary cross section of FIG. 2 taken along line 3—3 of FIG. 2.

FIGS. 2 and 3 depict an alternate embodiment of the device of the present invention which is responsive to increase in temperatures on both sides of a fluid barrier, for example a wall 50 of an air duct. This embodiment comprises a releasing device generally designated 52. The releasing deice 52 comprises a first releasable member or pawl 54; a dome-shaped mounting member 56, adapted for mounting over an aperture 58 in the wall 50; a first gripping means generally designated 60; a second releasable member or pawl 62; and a second gripping means generally designated 64. The mounting member 56 substantially encloses the aperture 58 in the wall 50 and is mounted to the wall 50 by suitable fastening means such as rivets 66. The concave surface of the dome-shaped mounting member 56 has, in the preferred embodiment, a flattened region 68 which faces the aperture 58. The mounting member 56 includes an aperture 70 in one of the walls thereof adapted to receive the pawl 54 therethrough.

The first gripping means 60 includes a bimetallic element 72 which is mounted on the flattened region 68 of the mounting member 56. When the device 52 is installed on the duct wall 50 as shown in FIGS. 2 and 3, the bimetallic element 72 is exposed to the ambient environment in the duct through the aperture 58. The bimetallic element 72 may be mounted directly to the mounting member 56 or may be indirectly mounted thereto by way of an inter mediate striker portion 74 as previously described. Such mountin may be effected by suitable fastening means such as rivets 76. A pin 78 extends from an end of the bimetallic element 72 which is remote from the aforementioned fastening means 76. The pin 78 located in proximity to the aperture 70 in the wall of the mounting member 56. The pawl 54 has an aperture 80 therein which is adapted to receive the pin 78 therethrough.

In the normal, unheated position, the bimetallic element 72 is disposed so that the pin 78 will extend through the aperture 80 in the pawl 54, whereby the end of the pin 78 which is remote from the bimetallic element 72, is adjacent the striker portion 74 as shown in FIG. 3. The end of the pin 78 is also beveled to permit the engagement of the pawl 54. When the gripping means is in the normal position, engagement of the pawl 54 is effected by inserting the pawl 54 through the aperture 70 in the mounting member 56 and thereafter against the bevel of the pin 78 thereby forcing the pin 78 away from the striker portion 74 and allowing the pawl 54 to slide into position in which the aperture 80 in the pawl 54 aligns with the pin 78 and is pierced thereby as pin 78 returns to its normal position adjacent the striker portion 74, as shown in FIG. 3.

The bimetallic element 72 should be so formed that is assumes the normal position when exposed to the ambient temperature of the its expected installation wherein, as shown for example in FIG. 3, the bimetallic element 72 is exposed to the ambient within the duct. The bimetallic element 72 itself if constructed as previously described with respect to the bimetallic element 24 of FIG. 1.

The second gripping means 64 comprises a mounting element 82 and a bimetallic element 84. The mounting element 82 and the bimetallic element 84 are attached to the pawl 54 by suitable fastening means such as rivets 86. The end of the mounting element 82 opposite the fastening means or rivets 86 is differentiated into an offset portion 88 and a striker portion 90.

A pin 92 extends from an end of the bimetallic element 84 which is remote from the aforementioned fastening means 86. The offset portion 88 has an aperture therein which is adapated to receive the pin 92 therethrough. The pawl 62 has an aperture therein which is also adapted to receive the pin 92 therethrough.

In the normal, unheated position, the bimetallic element 84 is disposed so that the pin 92 will extend through the aperture in the pawl 62, whereby the end of the pin 92 which is remote from the bimetallic element 84, is adjacent the striker portion 90 as shown in FIG. 3. The end of the pin 92 is also beveled to permit the engagement of the pawl 62. When the gripping means 64 is in the normal position, engagement of the pawl 62 is effected by inserting the pawl 62 between the offset portion 88 and the striker portion 90 and thereafter against the bevel of the pin 92 thereby forcing the pin 92 away from the striker portion 90 and allowing the pawl 62 to slide into position in which the aperture in the pawl 62 aligns with the pin 92 and is pierced thereby as pin 92 returns to its normal position adjacent the striker portion 90 as shown in FIG. 3.

The bimetallic element 84 should be so formed that it assumes the normal position when exposed to the ambient temperature of its expected installation wherein, as shown for example in FIGS. 2 and 3, the bimetallic element 84 is exposed to the ambient outside of the duct. The bimetallic element 84 itself is constructed as previously described with respect to the bimetallic element 24 of FIG. 1.

The pawl 62 has an attachment site 94 for attaching a cape 96 or other tension maintaining means such as chains or straps. The cable 96 is attached to the pawl 62 at the attachment site 94 on the outside of the duct and is threaded to a remote point along the duct wall 50 through a ferrule 98 and aperture 100 in the duct wall 50 to engage and operate associated fire protection apparatus, such as a damper (not shown), which is disposed within the duct. In the preferred embodiment, the location of the ferrule 98 relative to the attachment site 94 of the pawl 62 is such that a distance between the ferrule 98 and the attachment site 94 when the apparatus is set will, in turn, define the maximum travel of the cable 96 upon activation of the device 52.

A remotely actuatable device, for example, an electrically operated solenoid 102, is mounted on a flattened region 104 of the convex surface of the dome-shaped mounting number 56. The solenoid 102 is of a suitable type well-known in the art, having an operating rod 106 slidably mounted within the solenoid 102 and which extends therefrom in the direction indicating by arrow B in response to a voltage applied to wires 108. The operating rod 106 is also manually extensible by depressing a button 110 disposed on the end of the solenoid 102.

The operation of the releasing device 52 is as follows. In describing the operation, reference will be made to the use of the device in association with a fire damper within a duct. However, it will be understood that the device of the present invention is operable with respect to a plenum, chamber, or other forms of fluid containing or conducting means as well as other types of fire protection apparatuses, for example fire screens, associated therewith. The operation and function of the first releasable member or pawl 54, the mounting number 56 and the first gripping means 60 is the same as that previously described with respect to the device depicted in FIG. 1. The operation of the second gripping means 64 in selectively gripping or releasing the second pawl 62 is described in detail in by prior U.S. Pat. No. 3,889,314, and is incorporated herewith as if fully set forth herein.

As incorporated into the present invention, and shown in FIGS. 2 and 3, it can be seen that the configuration of the bimetallic element 84 exposes a large surface area thereof to the ambient air outside of the duct wall 50 which surrounds the second gripping means 64. As the temperature of the air outside of the duct rises, the bimetallic element 84 is heated, causing the end portion of the bimetallic element 84 having the pin 92 extending therefrom, to move in the direction indicated by arrow C. This movement causing a withdrawal from the pin 92 from the aperture in the pawl 62 and the consequent release of the pawl 62. The cable 96, having been kept under tension by the open damper, will be pulled into the duct through the ferrule 98 upon release of the pawl 62 by the second gripping means 64.

As shown in FIGS. 2 and 3 and as described above, it can be seen that this alternate embodiment releasing device of the present invention is extremely versatile and will enable closing of the damper or activation of other types of associated fire protection apparatus in a number of different ways. Release can be effectd either by a rise in temperature inside of the duct, a rise in temperature outside of the duct, manually by depressing the button 110 on the solenoid 102 or remotely by providing the requisite voltage to the wires 108 of the solenoid 102.

In addition to the versatility of release, it can be seen that no matter which of the gripping means has been activated to effect release, the entire device can be reset without having to gain access to the interior of the duct. If the first gripping means 60 had been activated causing release of the pawl 54, the device can be reset as previously described in the embodiment depicted in FIG. 1. If the second gripping means 64 had been activated to affect the release of the pawl 62, the device can be reset by simply inserting the pawl 62 into the second gripping means 64 whereby engagement of the pawl 62 is effected by pushing the pawl against a beveled surface of the pin 92 thereby forcing the pin 92 away from the striker portion 90 and allowing the pawl 62 to slide into the position in which the hole in the pawl 62 aligns with the pin 92 and is pierced thereby as the pin 92 returns to its normal position. Further, if both gripping means have been activated, for example, as a result of testing, resetting is easily effected by performing the above-described resetting operations in sequence.

Figure 4:
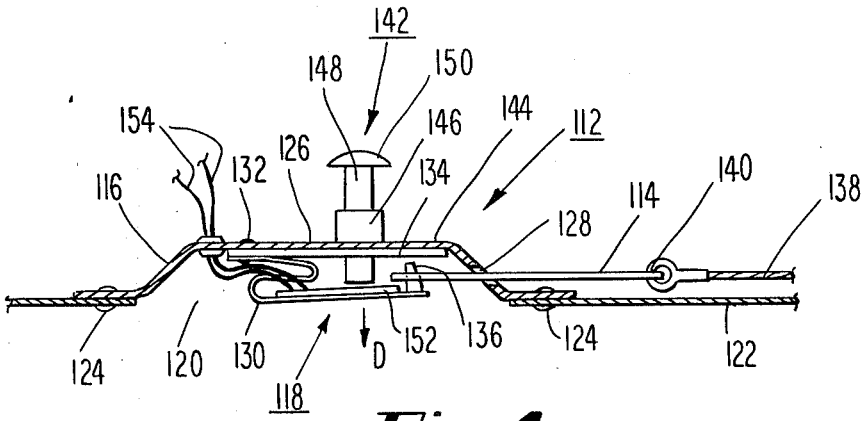
FIG. 4 is a side view of another embodiment of the releasable device of the present invention.

FIG. 4 depicts yet another alternate embodiment of a releasing device of the present invention, designated generally 112. The releasing device 112 comprises a releasable member or pawl 114; a mounting member 116; and a gripping means generally designated 118. The mounting member 116 is dome-shaped and is adapted for mounting over an aperture 120 in a fluid barrier such as, for example, a wall 122 of a duct. The dome-shaped mounting member 116 is fastened to the duct wall 122 by suitable fastening means, such as rivets 124. The concave surface of the dome-shaped mounting member 116 has, in the preferred embodiment, a flattened region 126 which faces the aperture 120. The mounting member 116 also includes an aperture 128 in one of the walls thereof adapted to receive the pawl 114 therethrough.

The gripping means 118 comprises a bimetallic element 130 which is mounted on the flattened region 126 by suitable attachment means, such as rivets 132 fastened at one end thereof. The bimetallic element 130 may be mounted directly to the mounting member 116 or may be indirectly mounted thereto by way of an intermediate striker portion 134 such as previously described herein. A pin 136 extends from one end of the bimetallic element 130 which is remote from the aforementioned fastening means 132. The pin 136 is located in proximity to the aperture 128 in the wall of the dome-shaped mounting member 116. The pawl 114 has an aperture therein which is adapted to receive the pin 136 therethrough.

In the normal, unheated position, the bimetallic element 130 is disposed so that the pin 136 will extend through the aperture in the pawl 114, whereby the end of the pin 136 which is remote from the bimetallic element 130 is adjacent the striker portion 134 as shown in FIG. 4. The end of the pin 136 is also beveled to permit the engagement of the pawl 114. When the gripping means 118 is in the normal position, engagement of the pawl 114 is effected by inserting the pawl 114 through the aperture 128 in the mounting member 116 and thereafter against the bevel of the pin 136 thereby forcing the pin 136 away from the striker portion 134 and allowing the pawl 114 to slide into position in which the aperture in the pawl 114 aligns with the pin 136 and is pierced thereby as the pin 136 returns to its normal position adjacent the striker portion 134 as shown in FIG. 4.

The bimetallic element 130 should be so formed that it assumes the normal position when exposed to the ambient temperature of the expected installation wherein, as shown for example in FIG. 4, the bimetallic element 130 is exposed to the ambient inside the duct by way of the aperture 120. The bimetallic element 130 itself is constructed as previously described with respect to the bimetallic element 24 of FIG. 1.

A cable 138 is attached to the pawl 114 at an attachment site 140. The cable 138 is routed along the outside of the duct wall 122, through a ferrule (not shown) located at a predetermined distance from the attachment site 140, and is subsequently connected to the fire protection apparatus actuatable by the releasing device 112. The predetermined distance is as previously defined with respect to the descriptions of the embodiments depicted in FIGS. 1, 2 and 3.

Manual releasing means, designated generally 142, is disposed on an outside flattened region 144 of the dome-shaped mounting member 16. This manual releasing means preferably comprises a cylindrical bushing 146 mounted against the flattened region 114 and surrounding an aperture (not shown) formed in the dome. The bushing and aperture are adapted to receive a central rod 148 having a rounded palm plate 150 on the exterior end thereof. A spring (not shown), disposed within the bushing 146 between the bushing 146 and the rod 148, tends to bias the rod 148 away from the metallic link 130. However, when the palm plate 150 is depressed, the rod 148 is pushed into the undersurface of the tip portion of the bimetallic element 130 in the direction indicated by arrow D to thereby withdraw the pin 136 out of the aperture in the pawl 114, to thereby activate the device.

An alternate means may be provided for remotely controlling the action of the bimetallic element 130. This means comprises an electrically heated element which, in its preferred embodiment, comprises nichrome wire 152 which is fastened, by any suitable means such as adhesive, to the surface of the bimetallic element 130. The element leads 154 provide a means to establish current flow through the nichrome wire 152 from any suitable controlled electrical source (not shown) to heat the wire 152 and the bimetallic element 130. Thus, when using this alternate embodiment, it is possible to energize the nichrome wire 152 and provide heat to the bimetallic element 130 causing the gripping means to release the pawl 114 in the manner previously described with respect to the heat activation of the embodiment of the device depicted in FIGS. 1, 2 and 3. Activation in this manner permits the fire damper, or whatever device is being controlled by the releasing device, to become operative. Additional details of the nichrome wire actuation means can be found in my prior U.S. Pat. No. 3,725,972, which is incorporated herewith as if fully set forth herein.

Figure 5:
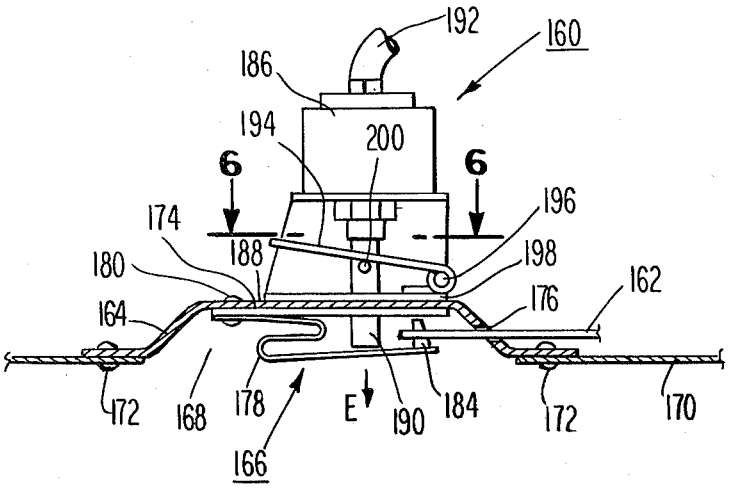
FIG. 5 is a side view of yet another embodiment of the releasable device of the present invention.
Figure 6:
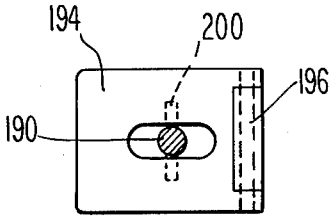
FIG. 6 is a fragmentary cross section along lines 6—6 of FIG. 5.

FIG. 5 depicts an additional alternate embodiment of a releasing device of the present invention, designated generally 160. The releasing device 160 comprises a releasable member or pawl 162; a mounting member 164; and a gripping means generally designated 166. The mounting member 164 is dome-shaped and is adapted for mounting over an aperture 168 in a fluid barrier such as, for example, a wall 170 of a duct. The dome-shaped mounting member 164 is fastened to the duct wall 170 by suitable fastening, means such as rivets 172. The concave surface of the dome-shaped mounting member 164 has, in the preferred embodiment, a flattened region 174 which faces the aperture 168. The mounting member 164 also includes an aperture 176 in one of the walls thereof adapted to receive the pawl 162 therethrough.

The gripping means 166 comprises a bimetallic element 178 which is mounted on the flattened region 174 by suitable attachment means such as rivets 180 fastened at one end thereof. The bimetallic element 178 may be mounted directly to the mounting member 164 or may be indirectly mounted thereto by way of an intermediate striker portion 182 such as previously described therein. A pin 184 extends from an end of the bimetallic element 178 which is remote from the aforementioned fastening means 180. The pin 184 is located in proximity to the aperture 176 in the wall of the dome-shaped mounted member 164. The pawl 162 has an aperture therein which is adapted to receive the pin 184 therethrough.

In the normal, unheated position, the bimetallic element 178 is disposed so that the pin 184 will extend through the aperture in the pawl 162, whereby the end of the pin 184 which is remote from the bimetallic element 178, is adjacent the striker portion 182 as shown in FIG. 5. The end of the pin 184 is also beveled to permit the engagement of the pawl 162. When the gripping means 166 is in the normal position, engagement of the pawl 162 is effected by inserting the pawl 162 through the aperture 176 in the mounting member 164 and thereafter against the bevel of the pin 184 thereby forcing the pin 184 away from the striker portion 182 and allowing the pawl 162 to slide into position in which the aperture in the pawl 162 aligns with the pin 184 and is pierced thereby as pin 184 returns to its normal position adjacent the striker portion 182 as shown in FIG. 5.

The bimetallic element 178 should be so formed that it assemes the normal position when exposed to the ambient temperature of the expected installation wherein, as shown for example in FIGS. 2 and 3, the bimetallic element 178 is exposed to the ambient inside of the duct by way of the aperture 168. The bimetallic element 178 itself is constructed as previously described with respect to the bimetallic element 24 of FIG. 1.

A cable (not shown) is attached to the pawl 162 and is routed along the outside of the duct wall, through a ferrule (not shown) located at a predetermined distance from the pawl attachment site, and is subsequently connected to the fire protection apparatus actuatable by releasing device 160 as previously described with respect to the embodiments depicted in FIGS. 1, 2, 3 and 4.

A remotely actuatable device, for example a pnuematically operated cylinder 186, is mounted on a flattened region 188 of the convex surface of the dome-shaped mounting member 164. The cylinder 186 is of a suitable type well known in the art, having an operating rod 190 slidably mounted within the cylinder 186 and which extends therefrom in the direction indicated by the arrow E in response to pressurized air applied to the cylinder 186 by means of the air line 192. The cylinder 186 may be of a double action type whereby the rod 190 both extends and retracts under influence of air pressure applied to the cylinder 186. The cylinder can also be of a single action type whereby the rod extends in the direction indicated the arrow E under the influence of applied air pressure and is subsequently forced to retract, after the air pressure has been removed and the ambient air within the duct has returned to within its normal prescribed limits under the influence of the movement of the bimetallic element 178 back to its normal position. The operating rod 190 is also manually extensible by depressing a lever 194, which is rotatably attached, by for example a hinge 196 to the mounting member 164 by way of an intermediate mounting plate 198 or directly thereto. The lever 194 engages a pin 200 which causes the operating rod 190 to extend in the direction indicated by the arrow E. The operating rod 190 will be returned to the position shown in FIG. 5 under the influence of the bimetallic element 178, as the bimetallic element 178 returns to its normal position.

It should be noted that the embodiments of the releasing devices depicted in FIGS. 1, 4 and 5 may be configured as shown by the embodiment depicted in FIGS. 2 and 3 by the addition, in tandem, of the second gripping means thereto. It should also be noted that the releasing device of the present invention is extremely versatile in that, for example the heating element shown in FIG. 4 can be added to any of the first and second gripping means shown in FIGS. 1, 2, 3 and 5 including both the first and second gripping means shown in FIGS. 2 and 3. Consequently, for example, it is possible to have a releasing device which is pnuematically activated, manually activated, and having two tandem gripping means which are actuatable by electrically heating the bimetallic element associated therewith.

It will be understood that various changes in the details, materials and arrangement of parts which have been herein described and illustrated in order to explain the nature of this invention may be made by those skilled in the art within the principle and scope of the invention as expressed in the following claims.

I claim:

1. A releasing device comprising:

(a) a releasable member;

(b) a substantially dome-shaped, mounting member, said dome-shaped member having a flattened portion at an apex thereof, a concave inner portion and a convex outer portion, said mounting member being adapted for mounting over an aperture in a fluid barrier, and further having an aperture therein for receiving said releasable member, said releasable member being adapted for insertion through said aperture in said mounting member from said outside portion to said inside portion; and (c) gripping means, mounted on said mounting member for engaging said releasable member when in a normal position after said releasable member has been inserted through said aperture in said mounting member said gripping means further being adapted to release said releasable member when in an activated position, said gripping means further comprising heat responsive means, said heat responsive means being mounted on the inside portion of the flattened portion of said dome-shaped member and further being adapted to cause said gripping means to move to said normal position in response to a preselected ambient temperature and to cause said gripping means to move to said activated position in response to a preselected increase in said ambient temperature.

2. The invention of claim 1 wherein said heat responsive means comprises a bimetallic element, one end of which is attached to said mounting member, and an opposite end having a pin extending therefrom for engaging an apertutre in said releasable member.

3. The invention of claim 2 wherein said bimetallic element has a serpentine configuration.

4. The invention of claim 3 wherein said pin is positioned adjacent said aperture in said mounting member and extends from said serpentine bimetallic element towards said flattened region of said inner portion, the end of said pin remote from said bimetallic element being adjacent said flattened region when said gripping means is in said normal position and moving away therefrom as said gripping means is moved from said normal position to said activated position, whereby said pin is withdrawn from said aperture in said releasable member.

5. The invention of claim 4 wherein said releasing device further comprises mechanical activation means mounted on the external portion of said mounting member for movement from a first withdrawn to a second extended position, said mechanical activation means in said first withdrawn position allowing said gripping means to move between said normal and said activated position and for causing said gripping means to move to the activated position in response to movement of said mechanical activation means to said second extended position.

6. The invention of claim 5 wherein said mechanical activation means further comprises force producing means and a ram, said force producing means being disposed on the outside portion of said mounting member and at least a portion of said ram being disposed through an aperture defined in said mounting member for engagement with said gripping means.

7. The invention of claim 6 wherein said force producing means comprises a manually operable palm plate.

8. The invention of claim 6 wherein said force producing means comprises a pnuematically operated cylinder.

9. The invention of claim 6 wherein said force producing means comprises an electrically operated solenoid.

10. The invention of claim 4 wherein said releasing device further includes a remotely controlled heating means connected to said bimetallic element for actuating said bimetallic element.

11. A releasing device comprising:

(a) a first releasable member;

(b) a mounting member adapted for mounting over an aperture in a fluid barrier, said mounting member having an aperture therein for receiving said first releasable member therethrough;

(c) a first gripping means, mounted on said mounting member, for engaging said first releasable member in a normal position and for releasing said first releasable member in an activated position, said first gripping means comprising first heat responsive means for causing said first gripping means to move to the normal position in response to a preselected first ambient temperature on one side of said fluid barriers and for causing said first gripping means to move to the activated position in response to a preselected increase in said ambient first temperature;

(d) a second releasable member;

(e) a second gripping means, connected to said first releasable member, for engaging said second releasable member in a normal position and for releasing said second releasable member in an activated position, said second gripping means comprising second heat responsive means for causing said second gripping means to move to the normal position in response to a preselected second ambient temperature on another side of said fluid barrier opposite said one side and for causing said second gripping means to move to the activated position in response to a preselected increase in said second ambient temperature.

12. The invention of claim 11 wherein said mounting member comprises an inside portion which faces said aperture when mounted thereover and an outside portion, said first gripping means being mounted on said inside portion and said first releasable member being adapted for insertion into the aperture in said mounting member from the outside portion to the inside portion wherein said first releasable member is engaged by said first gripping means in the normal position.

13. The invention of claim 12 wherein said mounting member is substantially dome-shaped having a concave inside portion and a convex outside portion.

14. The invention of claim 13 wherein said dome-shaped mounting member has a flattened portion at an apex thereof, said first heat responsive means being mounted on the inside portion of said flattened region.

15. The invention of claim 14 wherein said first heat responsive means comprises a first bimetallic element, one end of which is attached to said mounting member and an opposite end having a first pin extending therefrom for engaging an aperture in said first releasable member.

16. The invention of claim 15 wherein said second heat responsive heat comprises a second bimetallic element, one end of which is attached to said first releasable member and an opposite end having a second pin extending therefrom for engaging an aperture in said second releasable member.

17. The invention of claim 16 wherein each of said bimetallic elements has a serpentine configuration.

18. The invention of claim 17 wherein said first pin is positioned adjacent said aperture in said mounting member and extends from said first serpentine bimetallic element towards said flattened region of said inner portion of said mounting member, the end of said first pin remote from said first bimetallic element being adjacent said flattened region when said first gripping means is in said normal position and moving away therefrom as said first gripping means is moved from said normal position to said activated position, whereby said first pin is withdrawn from said aperture in said first releasable member.

19. The invention of claim 18 wherein said second pin extends from said second serpentine bimetallic element toward a striker portion, the end of said second pin remote from said second bimetallic element being adjacent said striker portion when said second gripping means is in said normal position and moving away therefrom as said second gripping means is moved from said normal position to said activated position, whereby said second pin is withdrawn from said aperture in said second releasable member.

20. The invention of claim 19 wherein said releasing device further comprises mechanical activation means mounted on the external portion of said mounting member for movement from a first withdrawn, to a second extended position, said mechanical activation means in said first withdrawn position allowing said first gripping means to move between said normal and said activated position and for causing said first gripping means to move to the activated position in response to movement of said mechanical activation means to said second extended position.

21. The invention of claim 20 wherein said mechanical activation means further comprises force producing means and a ram, said force producing means being disposed on the outside portion of said mounting member and at least a portion of said ram being disposed through an aperture defined in said mounting member for engagement with said first gripping means.

22. The invention of claim 21 wherein said force producing means comprises a manually operable palm plate.

23. The invention of claim 21 wherein said force producing means comprises a manually operable lever.

24. The invention of claim 21 wherein said force producing means comprises a pneumatically operated cylinder.

25. The invention of claim 21 wherein said force producing means comprises an electrically operated solenoid.

26. The invention of claim 19 wherein a remotely controlled heating means is connected to said first bimetallic element for actuating said first bimetallic elements.

27. The invention of claim 19 wherein a remotely controlled heating means is connected to said second bimetallic element for actuating said bimetallic element.

28. The invention of claim 6 wherein said force producing means comprises a manually operable lever.

* * * * *